US005685500A

United States Patent [19]

Eide et al.

[11] Patent Number: 5,685,500

[45] Date of Patent: Nov. 11, 1997

[54] MILL FOR GRINDING GARBAGE OR THE LIKE

[75] Inventors: Eric P. Eide; Russel L. Eide, II, both of Mondovi, Wis.

[73] Assignee: Wastenot International Ltd., Nassau, Bahamas

[21] Appl. No.: 317,705

[22] Filed: Oct. 3, 1994

Related U.S. Application Data

[63] Continuation-in-part of Ser. No. 53,522, Apr. 26, 1993.

[51] Int. Cl.[6] ..... B02C 7/02

[52] U.S. Cl. ..... 241/154; 241/275

[58] Field of Search ..... 241/154, 152.2, 241/152.1, 285.1, 46, 197, 275, 32

[56] References Cited

U.S. PATENT DOCUMENTS

| | | | |
|---|---|---|---|
| 248,923 | 11/1881 | Déchamp | 241/154 |
| 1,212,419 | 1/1917 | Sturtevant | 241/154 |
| 1,558,394 | 10/1925 | Rice | 241/32 |
| 1,619,295 | 3/1927 | Gardner | 241/19 |
| 1,669,239 | 5/1928 | Grindle . | |
| 1,758,010 | 5/1930 | Pettinos | 241/154 |
| 1,798,465 | 3/1931 | Grindle . | |
| 2,093,703 | 9/1937 | Blodgett | 241/154 X |
| 2,174,630 | 10/1939 | Hardinge | 241/54 X |
| 2,355,784 | 8/1944 | Dondlinger | 241/56 X |
| 2,392,958 | 1/1946 | Tice | 241/285 R X |
| 2,639,747 | 5/1953 | Burn et al. . | |
| 2,700,512 | 1/1955 | Denovan et al. | 241/56 X |
| 2,787,108 | 4/1957 | Meltzer . | |
| 2,940,738 | 6/1960 | Posener et al. | 241/282.1 X |
| 3,065,919 | 11/1962 | Burkett et al. . | |
| 3,160,354 | 12/1964 | Burkett | 241/275 |
| 3,490,704 | 1/1970 | Bourne et al. | 241/154 |
| 3,555,996 | 1/1971 | Schwarz et al. . | |

FOREIGN PATENT DOCUMENTS

| | | | |
|---|---|---|---|
| 276849 | 8/1988 | European Pat. Off. | 241/197 |
| 532773 | 3/1991 | European Pat. Off. . | |
| 384236 | 4/1908 | France . | |
| 665736 | 9/1938 | Germany | 241/197 |
| 1248438 | 8/1967 | Germany | 241/197 |
| 2423669 | 11/1975 | Germany . | |
| 3144071 | 5/1983 | Germany . | |
| 1080854 | 3/1984 | U.S.S.R. | 241/154 |
| 1126320 | 11/1984 | U.S.S.R. . | |
| 688523 | 3/1953 | United Kingdom . | |

(List continued on next page.)

*Primary Examiner*—Douglas D. Watts

*Attorney, Agent, or Firm*—Peterson, Wicks, Nemer & Kamrath, P.A.

[57] ABSTRACT

A mill (10) for grinding garbage or like material is disclosed including grinding rotors (48–50) rotatably fixed to and longitudinally adjustable on a shaft (44) rotatable in a grinding chamber (26). Each of the rotors (48–50) include a multiplicity of arms (64) extending radially from a circular disc (54). The arms (64) have replaceable tips (284) including first and second legs (288, 290) forming an L-shaped body portion. First and second bolts (308) extend through apertures (310) in the arm (64) and are threaded into apertures (312) in the first leg (288). A third bolt (314) extends through a counterbore (320) and an aperture (316) in the second leg (290) and is threaded into aperture (318) of the radially outer end of the arm (64). Material anti-wrap provisions (140) in the form of wing plates (240) oriented to extend generally radially from the shaft (44) are provided between the top plate (28) and the first rotor (28) and also between the rotors (48–50). The wing plates (240) include bars (242, 244) which are slideable relative to each other to variable, fixed lengths parallel to the shaft (44). The provisions (140) between the rotors (48–50) include feet (260, 262) secured to the rotors (48–50) by the bolts (130) which secure the arms (64) to the disc (54). The provisions (140) above the first rotor (48) are secured to the shaft (44) by semicylindrical carriers (**264*a,b*) including C-shaped disks (272) secured to the upper edges (266) thereof, with pins (274) upstanding from the disks (272) acting as a barrier for the bearing (46) of the shaft (44**).

24 Claims, 4 Drawing Sheets

U.S. PATENT DOCUMENTS

| | | | |
|---|---|---|---|
| 3,873,034 | 3/1975 | Iwahori et al. . | |
| 3,987,970 | 10/1976 | Burkett | 241/154 X |
| 4,030,670 | 6/1977 | Abernathy . | |
| 4,098,466 | 7/1978 | MacElvain et al. . | |
| 4,117,655 | 10/1978 | Smith . | |
| 4,144,167 | 3/1979 | Burkett et al. | 241/154 X |
| 4,151,794 | 5/1979 | Burkett | 241/154 X |
| 4,439,459 | 3/1984 | Burkett | 241/152.2 |
| 4,472,928 | 9/1984 | Easton . | |
| 4,493,459 | 1/1985 | Burkett | 241/154 X |
| 4,593,861 | 6/1986 | Blakley et al. | 241/257.1 X |
| 4,637,561 | 1/1987 | Edberg | 241/154 |
| 4,690,338 | 9/1987 | Sayler et al. | 241/154 X |
| 5,114,085 | 5/1992 | Inui | 241/197 X |
| 5,192,029 | 3/1993 | Harris . | |
| 5,236,133 | 8/1993 | Lundquist | 241/79.1 |

MILL FOR GRINDING GARBAGE OR THE LIKE

CROSS REFERENCE

This application is a continuation-in-part of application Ser. No. 08/053,522 filed Apr. 26, 1993.

BACKGROUND

The present invention generally relates to mills for grinding material and particularly to grinding mills for garbage or like material.

A critical problem in today's society is the disposal of solid waste which is generated every day. One method to minimize this problem is to reduce the compacted volume of the garbage. This can be performed by grinding the garbage to reduce the garbage volume by 4 to 1 or more and thereby extending the life of a landfill by that ratio.

Thus, a need exists for mills for grinding garbage or like material which is able to grind the garbage to the desired size and to do so efficiently and economically. Such mills should be economical to manufacture and should be able to withstand the forces associated with grinding garbage or encountered when grinding objects which may be found in garbage.

SUMMARY

The present invention solves this need and other problems in grinding garbage or like material by providing, in one aspect, a mill including a plurality of wing plates mounted to extend radially from a rotating shaft at circumferentially spaced locations to effectively increase the circumference of the rotating shaft to combat wrapping of material around the shaft.

In preferred aspects of the present invention, the wing plates have a variable, fixed length parallel to the rotating shaft preserving the ability to longitudinally adjust rotors on the shaft.

In further aspects of the present invention, the upper axial ends of the wing plates are located within the axial extent of a deflector for preventing material from axially entering the upper axial end of the wing plates and for covering any exposed portions of the shaft extending beyond the upper axial ends of the wing plates.

In other aspects of the present invention, a replaceable tip is provided including a body portion secured to the rotor arm by bolts extending through the rotor arm and threaded into a first leg of the body portion and by a bolt extending through a second leg of the body portion and threaded into the radially outer end of the rotor arm.

In preferred aspects of the present invention, the rotor arm includes a cut-out for at least partially receiving the first leg of the body portion, and the head of the bolt is recessed in a counterbore formed in the second leg.

It is thus an object of the present invention to provide a novel mill for grinding.

It is further an object of the present invention to provide such a novel grinding mill for garbage.

It is further an object of the present invention to provide such a novel grinding mill which may be operated efficiently and economically.

It is further an object of the present invention to provide such a novel grinding mill which is economical to manufacture.

It is further an object of the present invention to provide such a novel grinding mill which reduces downtime.

It is further an object of the present invention to provide such a novel grinding mill allowing ease of replacement of rotor wear portions to reduce downtime.

It is further an object of the present invention to provide such a novel grinding mill allowing ease of removal of wrapped material on the rotor assembly to reduce downtime.

It is further an object of the present invention to provide such a novel grinding mill which can be manufactured from stock materials.

It is further an object of the present invention to provide such a novel grinding mill able to withstand the forces associated with grinding garbage or encountered when grinding objects which may be found in garbage.

It is further an object of the present invention to provide such a novel grinding mill which is relatively safe in comparison with tub grinders or hammer mills.

It is further an object of the present invention to provide such a novel grinding mill formed by planar rotors formed of planar components which are arranged parallel to planar shelves of a grinding chamber.

It is further an object of the present invention to provide such a novel grinding mill including members provided on the grinding rotors for enhancing the vacuum created by the impeller rotor and the movement of the ground material through the mill.

It is further an object of the present invention to provide such a novel grinding mill having provisions for economically replacing wear in the grinding rotors.

It is further an object of the present invention to provide such a novel grinding mill which effectively increases the circumference of the rotating shaft to combat wrapping of material thereon.

It is further an object of the present invention to provide such a novel grinding mill which allows relative ease of removal of material which does wrap on the rotating shaft.

It is further an object of the present invention to provide such a novel grinding mill which serves to protect the bearings rotatably supporting the rotor assembly.

It is further an object of the present invention to provide such a novel grinding mill which covers any exposed portions of the shaft extending beyond the upper axial end of the anti-wrap device.

It is further an object of the present invention to provide such a novel grinding mill which prevents material from axially entering the anti-wrap device.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
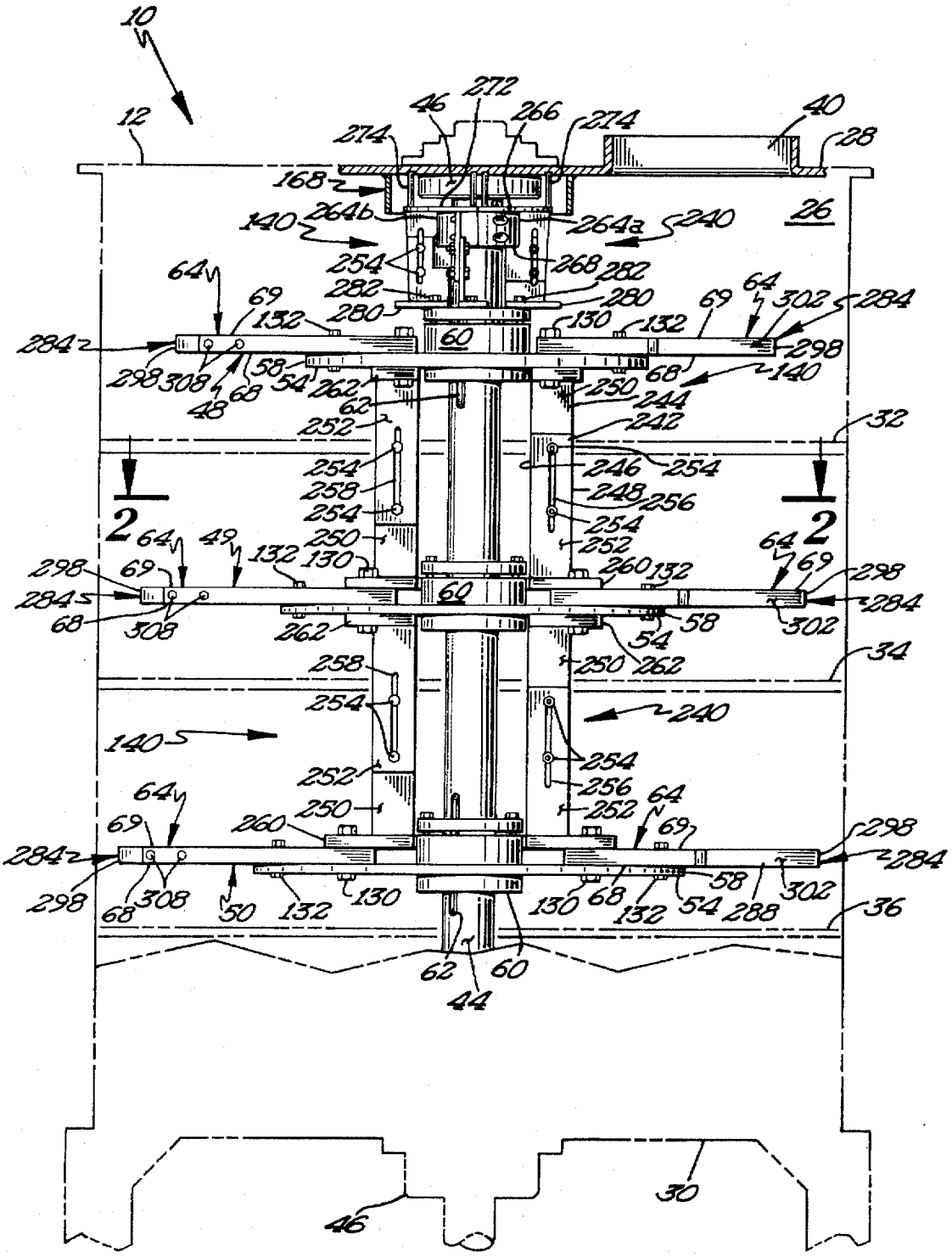
FIG. 1 shows a front view of a garbage grinding mill according to the preferred teachings of the present invention, with the housing shown in phantom.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "upper", "lower", "vertical", "horizontal", "rearward", "end", "side", "edge", "axial", "radial", and similar terms are used herein, it should be understood that these terms have reference only to the structure shown in the drawings as it would appear to a person viewing the drawings and are utilized only to facilitate describing the invention.

DESCRIPTION

A mill according to the preferred teachings of the present invention is shown in the drawings in the preferred form and is generally designated 10. In the most preferred embodiments of the present invention, mill 10 is an improvement of the type shown and described in U.S. Pat. Nos. 4,989,796; 5,067,661; and 5,205,500 and U.S. patent application Ser. No. 08/053,522. For purpose of explanation of the basic teachings of the present invention, the same numerals designate the same or similar parts in the present figures and the figures of U.S. Pat. Nos. 4,989,796; 5,067,661; and 5,205,500 and U.S. patent application Ser. No. 08/053,522. The description of the common numerals and mill 10 may be found herein and in U.S. Pat. Nos. 4,989,796; 5,067,661; and 5,205,500 and U.S. patent application Ser. No. 08/053,522, which are hereby incorporated herein by reference.

Referring to the drawings in detail, mill 10 generally includes a housing 12 defining a grinding chamber 26 having a top plate 28 and a bottom plate 30. An inlet opening 40 to chamber 26 is formed in top plate 28. Chamber 26 of housing 12 is divided into sections by horizontal shelves 32, 34, and 36, with each of shelves 32, 34, and 36 including a centrally located aperture 38.

Mill 10 further includes a shaft 44 rotatably mounted in chamber 26 concentrically within apertures 38 of shelves 32, 34, and 36. In the most preferred form, shaft 44 is vertical and is rotatably mounted by bearings 46 located in top and bottom plates 28 and 30. Shaft 44 may be driven in any suitable manner including but not limited to by the drive device shown and described in U.S. Pat. No. 5,314,386 which is hereby incorporated herein by reference. Mill 10 further includes rotors 48, 49, and 50 rotatably fixed to shaft 44 and located complementary to and intermediate top plate 28 and shelves 32, 34, and 36 and in the most preferred form are located above shelves 32, 34, and 36, respectively. Rotors 48–50 each include a circular, flat or planar disc 54 having a central opening and a circular periphery 58. A hub assembly 60 which is longitudinally adjustable but rotatably fixed on shaft 44 along a keyway 62 is located within and attached to the central opening of disc 54.

Rotors 48–50 are in the form of grinding rotors and further include a multiplicity of arms 64 dynamically mounted on and extending radially from discs 54 and circumferentially spaced from each other. Arms 64 are elongated and flat or planar and have generally rectangular cross sections. In the most preferred form, arms 64 are horizontal with the first or bottom surface 68 of arms 64 abutting directly with the top surface of discs 54, with arms 64 being rotatable about an axis perpendicular to surfaces 68. Arms 64 are attached to discs 54 adjacent to their radially inner ends by a first bolt 130 of relatively high shear strength and second and third shear bolts 132 of lesser shear strength than bolt 130, with first bolt 130 located on a radial line from the rotational axis of shaft 44 at a first radial distance from shaft 44 and second and third bolts 132 located on opposite sides of the radial line from the rotation axis of shaft 44 extending through bolt 130 and at a second radial distance from shaft 44. In the most preferred form, the first radial distance is less than the second radial distance. The advantage of this attachment arrangement is that in the event that arms 64 of rotors 48–50 should strike an object which is not impelled by arms 64, broken by arms 64, or otherwise is unable to pass by arms 64 due to weight, size, or the like, second and third bolts 132 are allowed to be sheared such that arm 64 is allowed to pivot out of the way of the object about first bolt 130.

According to the preferred teachings of the present invention, mill 10 further includes provisions 140 for combating the problem of material wrapping on shaft 44 rotatable about its axis within grinding chamber 26 defined by housing 12, with grinding chamber 26 being substantially larger than shaft 44. Specifically, material wrapping on shaft 44 is problematic because it can affect dynamic balancing of the rotor assembly, can migrate to and damage bearings 46 and the seals therefore, and typically requires removal before longitudinal adjustment of rotors 48–50 on shaft 44 can be performed thus increasing downtime of mill 10. In the most preferred form, anti-wrap provisions 140 include telescopic wing plates 240 which are telescopic in a direction which is parallel to shaft 44 to be of a readily variable, fixed length parallel to shaft 44 and the rotation axis thereof. In the most preferred form, wing plates 240 each include first and second flat bars 242 and 244 each having generally rectangular cross sections and specifically including an inner edge 246, an outer edge 248, a first face 250, and a second face 252. In the preferred form, first faces 250 of bars 242 and 244 abut and are slideable relative to each other. In the most preferred form, bars 242 and 244 are adjustably held in various telescopic relations by bolts 254 which extend through slots 256 and 258 formed in bars 242 and 244, respectively, extending through faces 250 and 252 parallel to edges 246 and 248 and to shaft 44.

Figure 2:
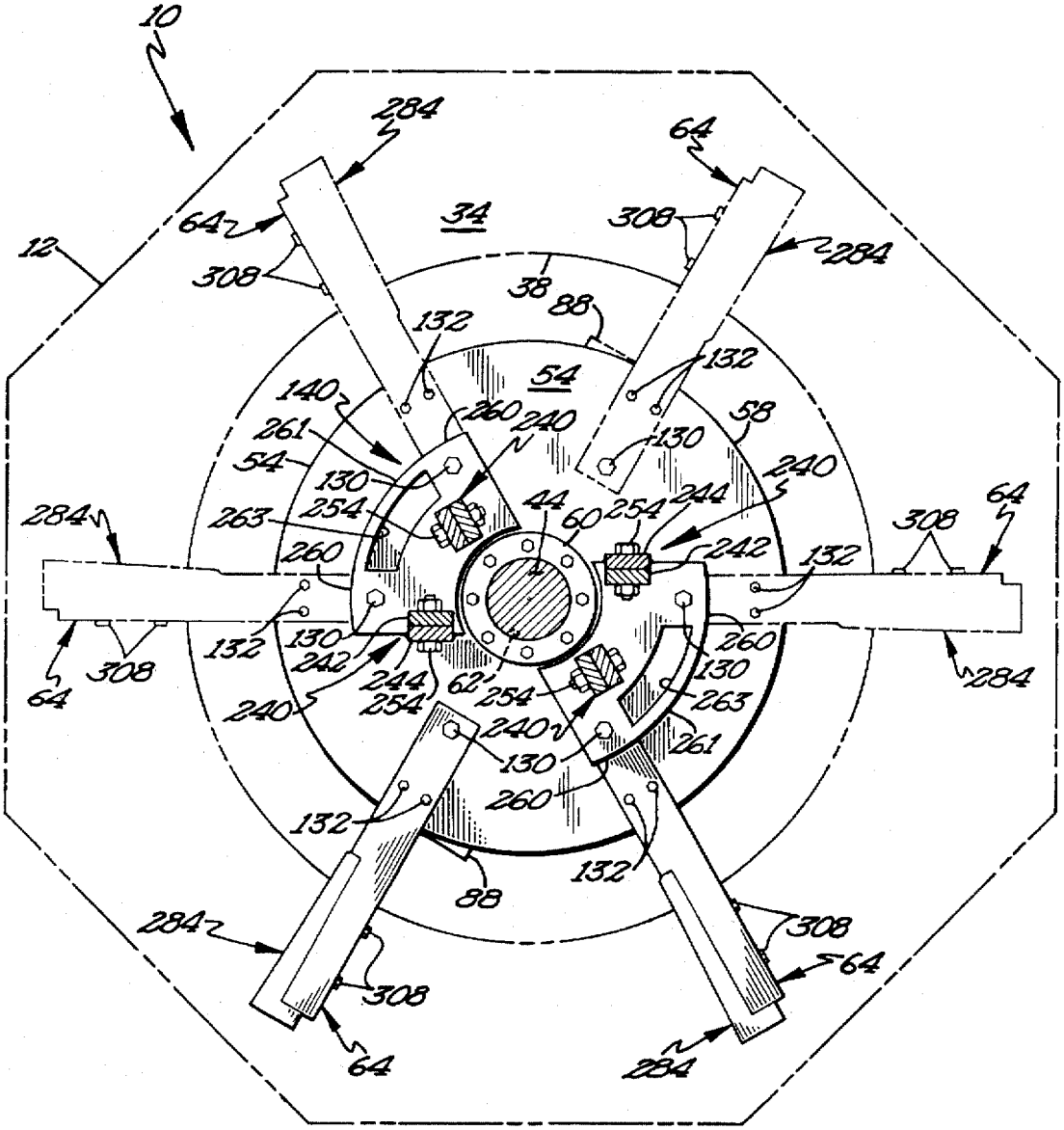
FIG. 2 shows a cross-sectional view of the garbage grinding mill of FIG. 1 according to section line 2–2 of FIG. 1.
Figure 3:
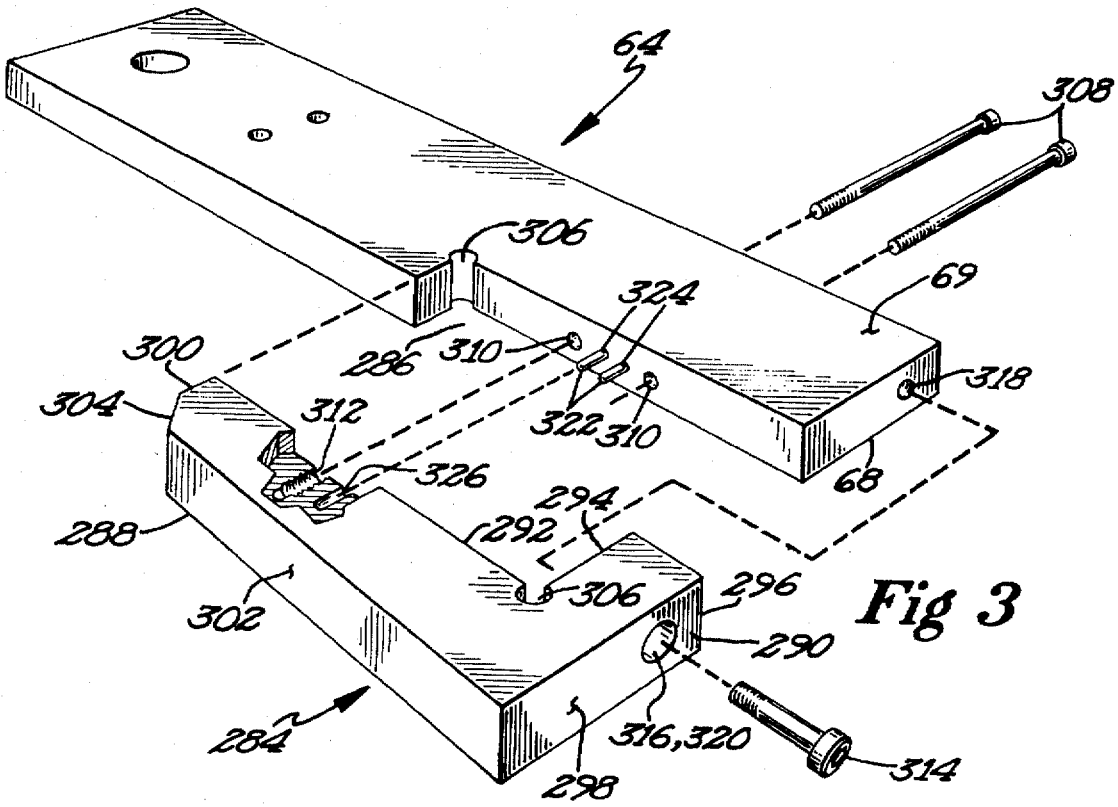
FIG. 3 shows an exploded view of the arm of the rotor of the garbage grinding mill of FIG. 1.
Figure 4:
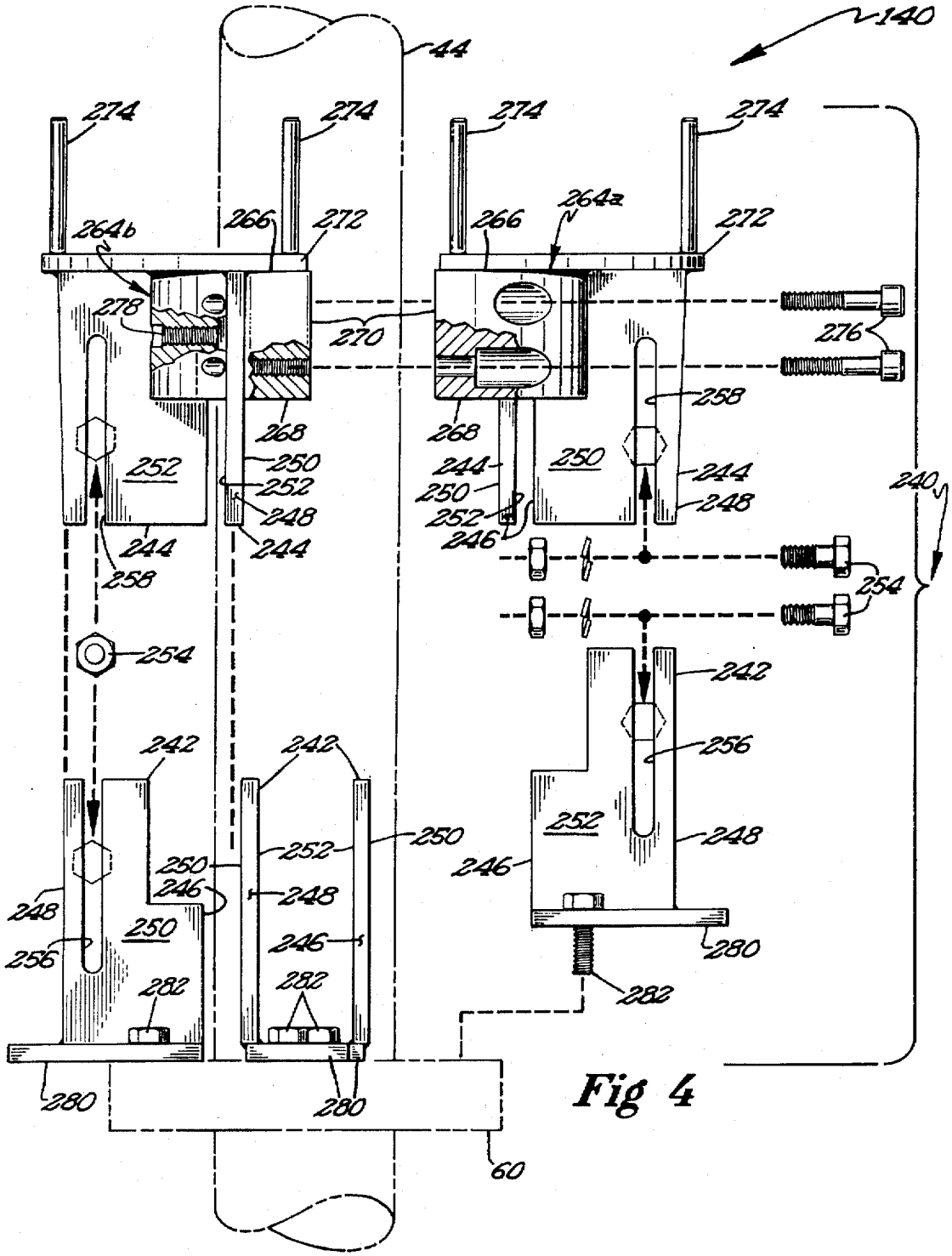
FIG. 4 shows an exploded perspective view of the anti-wrap provisions located between the top plate and the first rotor of the garbage grinding mill of FIG. 1.

Provisions 140 further include structure for holding wing plates 240 relative to shaft 44 with edges 248 being radially spaced from shaft 44 greater than the radial spacing of edges 246 from shaft 44 and without direct attachment to shaft 44. In the most preferred form as best seen in FIG. 2, faces 250 and 252 are parallel to and spaced behind the radial line from the rotation axis of shaft 44 extending through bolt 130 in the rotation direction of rotors 48–50. However, faces 250 and 252 could be arranged at a small acute angle rearward of the radial line from the rotation axis of shaft 44 extending through bolt 130 in the rotation direction of rotors 48–50. In either case, bars 242 and 244 are offset from bolts 130 providing access to the adjustment bolts of the hub assembly 60 and to bolts 130 and 132 by a wrench or the like in the circumferential spacing between wing plates 240.

In the most preferred form for provisions 140 located between rotors 48 and 49 and between rotors 49 and 50, the lower end of bar 242 and the upper end of bar 244 include an integral foot 260 and 262, respectively. Feet 260 and 262 are flat or planar having generally rectangular cross sections. In the most preferred form, feet 260 and 262 are horizontal and extend generally perpendicular to bars 242 and 244 at a close tolerance, with bars 242 and 244 extending through apertures in feet 260 and 262 to allow welding or other securement of bars 242 and 244 to feet 260 and 262 on both the top and bottom of feet 260 and 262. The consistency of positioning bars 242 and 244 relative to feet 260 and 262 is important for dynamic balancing of the rotor assembly and for proper alignment of slots 256 and 258 for ease of adjustment in the length of wing plates 240. Suitable braces can be provided between bars 242 and 244 and feet 260 and 262, respectively, if desired or required.

The lower, outer surface of foot 260 abuts directly with the second or top surface 69 of arms 64 and is attached to arms 64 and discs 54 by bolt 130 extending through apertures formed in discs 54, arms 64, and foot 260. Similarly, the upper, outer surface of foot 262 abuts directly with the bottom surface of disc 54 and is attached to disc 54 by bolt 130 extending through apertures formed in discs 54, arms 64, and foot 262. It can be appreciated that bolts 130 of rotor 49 extend through apertures formed in feet 260 of provisions 140 located between rotors 48 and 49, arms 64 and disc 54 of rotor 49 and feet 262 of provisions 140 located between rotors 49 and 50. In the preferred form, six arms 64 are provided in each of rotors 48–50, with four wing plates 240 being provided on diametrically opposite arms 64 and with flaps 88 abutting directly with the bottom surface of disc 54 and attached thereto by bolts 130 and 132 on the remaining 2 diametrically opposite arms 64. In the most preferred form, two circumferentially adjacent feet 260 are integrally connected together by a web 261 to prevent feet 260 from spinning on bolts 130 which can occur due to the effect of centrifugal forces created since wing plates 240 are not radially in line with bolts 130 and the rotation axis of shaft 44. Cut-outs 263 are provided in web 261 to reduce weight and for ease of handling of provisions 140.

In the most preferred form, anti-wrap provisions 140 located between rotor 48 and top plate 28 include first and second semicylindrical carriers **264*a* and 264*b*. In the most preferred form, carriers 264*a* and 264*b* are fabricated from cutting a steel tube having an inner diameter generally equal to the outside diameter of shaft 44 longitudinally in half, with the steel tube being prefabricated or fabricated from a steel plate. It can then be appreciated that the material removed from the steel tube when it is cut into two halves serves to make the inner diameters of carriers 264*a* and 264*b* to be slightly smaller than the outside diameter of shaft 44. Carriers 264*a* and 264*b* each include upper edges 266, lower edges 268 and first and second free, longitudinally extending edges 270. Carriers 264*a* and 264*b* each further include a C-shaped disk 272 secured to the upper edge 266 and extending generally perpendicular to the inner and outer surfaces of carriers 264*a* and 264*b*. The inner edge of plates 272 has a radius generally equal to that of shaft 44 and carriers 264*a* and 264*b*. The outer edge of plates 272 has a radius substantially greater than that of shaft 44 and carriers 264*a* and 264*b* and at least slightly greater than bearing 46 in top plate 28. The outer edge of plates 272 has a radius at least slightly smaller than the radial extent of inlet opening 40 from shaft 44. Disks 272 further include three pins 274 which upstand therefrom opposite to carriers 264*a* and 264*b* adjacent to the outer edge thereof, with first and second pins 274 located adjacent the ends of plates 272 and the third pin 274 located intermediate the ends of plates 272. Pins 274 are positioned at a radial spacing from the rotational axis of shaft 44 generally equal to but slightly greater than that of bearing 46 in top plate 28 and upstand from disc 272 to a height generally equal to but slightly less than the thickness of bearing 46 from the bottom surface of top plate 28**.

Carriers **264*a* and 264*b* are secured to each other by suitable means such as bolts 276 extending through counter bored apertures into threaded apertures extending parallel to a tangent to the inside and outside diameters of carriers 264*a* and 264*b*. Thus, shaft 44 is sandwiched between and captured by carriers 264*a* and 264*b*. To insure that carriers 264*a* and 264*b* do not spin or rotate relative to shaft 44, set screws 278 threadably extend through carriers 264*a* and 264*b* and abut with shaft 44**.

The upper ends of bars 244 of anti-wrap provisions 140 located between top plate 28 and rotor 48 are integrally secured such as by welding to disks 272 and/or carriers **264*a* and 264*b*. In the most preferred form, inner edges 246 of bars 244 include a cut-out for carriers 264*a* and 264*b* such that abutment of shaft 44 by inner edges 246 of bars 244 is possible below carriers 264*a* and 264*b*. The lower ends of bars 242 of anti-wrap provisions 140 located between top plate 28 and rotor 48 are integrally secured such as by welding to feet 280 which are flat or planar having generally rectangular cross sections. In the most preferred form, feet 280 are horizontal and extend generally perpendicular to bars 242. The lower, outer surfaces of feet 280 abut directly with the top surface of hub assembly 60 and are attached thereto by bolts 282 which extend through apertures formed in feet 280 and are threaded into hub assembly 60. Inner edges 246 of bars 242 which generally abut with shaft 44 include a cut-out for carriers 264*a* and 264*b* to allow the upper end of bars 242 to slide past lower edges 268. In the most preferred form, the outer edges 248 of bars 242 and 244 of plates 240 taper toward shaft 44 with edges 248 being radially spaced from shaft 44 greater adjacent to disks 272 than adjacent to feet 280 to direct any material which should wrap around provisions 140 toward rotor 48 and away from bearing 46** and the seal therefor.

It can then be appreciated that provisions 140 according to the preferred teachings of the present invention can be easily installed during manufacture of mill 10 or as an after-market product for an existing mill 10. Specifically, with bolts 254 loosened, bars 242 and 244 are allowed to telescope such that the axial length of wing plates 240 parallel to shaft 44 can be adjusted to match the axial spacing between rotors 48–50 and between rotor 48 and top plate 28. When rotors 48–50 are at their desired locations, hub assemblies 60 can be axially fixed on shaft 44 and bolts 254 can be tightened to hold bars 242 and 244 at the required telescopic lengths of wing plates 240.

During operation of mill 10 and specifically during rotation of shaft 44 and rotors 48–50, anti-wrap provisions 140 rotate therewith. It can then be appreciated that anti-wrap provisions 140 are very effective in combating material wrapping on shaft 44 and allow for ease of removal of any material which does wrap on the rotor assembly. Particularly, the length of material typically has to be at least two times the circumference of the rotating part in order to successfully wrap around the circumference. It can then be appreciated that plates 240 effectively increase the circumference of shaft 44 by a multiple and in the most preferred form by a multiple of at least 2.75 for provisions 140 located between top plate 28 and rotor 48 and much greater for provisions 140 located between rotors 48–50. Thus, although the effective circumference of shaft 44 defined by the radial extent of outer edges 248 of wing plates 240 is substantially smaller than grinding chamber 26, there will be fewer available items long enough to wrap around the effective circumference of plates 240 than would be available to wrap around shaft 44. Additionally, rotation of plates 240 serves as a blower to create positive pressure around shaft 44 which in turn actually repels material away from shaft 44. Shaft 44 without provisions 140 can actually create a negative pressure next to the outside surface of shaft 44 which will attract material to shaft 44 which can wrap thereon. Furthermore, in the event that material should wrap around plates 240, cavities are created between plates 240 that enable a cutting tool to get behind and around material wrapped around plates 240 allowing the wrapped material to be cut away. When material wrapped upon shaft 44 not including provisions 140, it was very difficult to cut the wrapped material because it was difficult to get behind the wrapped material to cut it off. The ease of removal of material wrapped around the rotor assembly is important in reducing downtime of mill 10 when it is desired to adjust rotors 48–50 on shaft 44, replace components on rotors 48–50, or similar servicing of mill 10.

Typically, if material wraps around provisions 140 between rotors 48–50 according to the preferred teachings of the present invention, one end of the material would wrap around one of wing plates 240 and then the material would wrap around outer edges 248 of all of wing plates 240 in provisions 140. To prevent an end from wrapping around one of wing plates 240, a removable and adjustable shield to prevent material and specifically an end thereof from getting between shaft 44 and one or more of wing plates 240 can be provided, and thus producing an effect similar to abutting inner edges 246 of wing plates 240 against shaft 44 in provisions 140 located between top plate 28 and rotor 48. Such a shield may also have other functions including affecting the disintegration process.

Provisions 140 according to the preferred teachings of the present invention preserve the ability of arms 64 to pivot out of the way in the event that bolts 132 are sheared. Furthermore, provisions 140 according to the preferred teachings of the present invention preserve the ability to longitudinally adjust rotors 48–50 along shaft 44 by allowing access by wrenches or the like to the bolts or other securement devices of hub assembly 60 between plates 240 and also due to the variable length of plates 240 parallel to shaft 44. Also, provisions 140 provide shaft 44 with an increased resistance to bending by effectively increasing the diameter of shaft 44 and spreading bending stress linearly down shaft 44. This spreading of stress results in less force load acting on shaft 44 in any one cross-sectional area.

In the most preferred form, provisions 140 are provided on shaft 44 between top plate 28 and rotor 48, between rotors 48 and 49, and between rotors 49 and 50. The material passing through aperture 38 of shelf 36 typically will not be of a size that wrapping around shaft 44 below rotor 50 is as critical a problem than above rotor 50. However, it can be appreciated that provisions 140 can be located below rotor 50 if material wrapping upon shaft 44 below rotor 50 becomes a problem. As provisions 140 abut with and extend between rotors 48–50, migration of any material which wraps or partially wraps around plates 240 is not a problem. Provisions 140 between top plate 28 and rotor 48 protect bearing 46 and its seal from flying and wrapping debris by acting as a physical barrier. Disks 272 generally prevent any material which wraps or partially wraps around plates 240 of provisions 140 located between top plate 28 and rotor 48 from migrating past. Pins 274 effectively increase the circumference of shaft 44 above disks 272 and within bearing 46 to combat material from grinding chamber 26 or migrating past disk 272 wrapping around bearing 46 which could have a tendency to migrate down onto shaft 44. It can be appreciated that pins 274 could take other forms according to the teachings of the present invention such as semi-cylindrical plates.

In the most preferred form, a deflector 168 is secured to the underside of top plate 28 to protect bearing 46 by preventing material from axially entering the upper axial end of provisions 140 located between top plate 28 and rotor 48. In the most preferred form, deflector 168 includes a cylindrical member having a diameter larger than provisions 140 and a radius generally equal to the spacing between the axis of shaft 44 and inlet opening 40 in the most preferred form. Deflector 168 further includes first and second, parallel, attachment bars extending across the upper axial end of the cylindrical member along a chord of the cylindrical member and on opposite sides of shaft 44. The attachment bars 172 can be attached to the underside of top plate 28 by any suitable means such as by bolts. Thus, shaft 44 and provisions 140 rotate about their axis relative to deflector 168 of top plate 28. Deflector 168 is especially important to prevent the momentum of material entering mill 10 through inlet opening 40 from carrying the material adjacent and generally parallel to top plate 28 and axially entering the upper axial ends of pins 274. A similar deflector 168 can be provided on bottom plate 30 to protect bearing 46 thereof.

According to the preferred teachings of the present invention, mill 10 further includes replaceable tips 284 for arms 64. Specifically, arms 64 in the most preferred form each include a rectangular-shaped cut-out 286 located at the leading corner of the radially outer end of arm 64 in the direction of rotation of arm 64. Cut-out 286 has a radial length generally equal to 40% of the radial length of arm 64 and a circumferential width perpendicular to the radial length equal to 25% of that of arm 64. Tips 284 have a thickness generally equal to or greater than the axial thickness of arm 64 and in the most preferred form have a thickness equal to 115% to 125% of the thickness of arm 64 to help protect surfaces 68 and 69 of arms 64 from wear. Tips 284 are each generally L-shaped and include first and second legs 288 and 290. In particular, leg 288 includes an inner surface 292 having a radial length generally equal to the radial length of cut-out 286. Leg 290 includes an inner surface 294 which is generally perpendicular to surface 292 and has a width greater than the circumferential width of cut-out 286. Leg 290 includes a free end 296 which is generally perpendicular to surface 294 and has a radial length generally equal to 27% of the radial length of cut-out 286 and of surface 292. It can be appreciated that the radial length of free end 296 can be varied to adjust the spacing of surface 298 from housing 12 to thus adjust the garbage shred size of mill 10 according to the teachings of the present invention. Leg 290 further includes an outer surface 298 which is generally perpendicular to end 296 and parallel to surface 294 and having a width greater than the width of surface 294 and in the most preferred form generally equal to the circumferential width of arms 64.

Leg 288 includes a free end 300 which is generally perpendicular to surface 292 and has a width greater than the circumferential width of cut-out 286 and in the most preferred form which is less than the difference between the widths of surfaces 294 and 298. Leg 288 further includes an outer surface 302 which is at a small obtuse angle in the order of 92° to end 300 and a large acute angle to surface 298. In the most preferred form, a chamfer 304 is formed between end 300 and surface 302 having a width along the end generally equal to the difference between the widths of end 300 and cut-out 286. The corner between surfaces 292 and 294 and the inner corner of cut-out 286 can be relieved such as by a drill bore or flame cut radius or fillet 306 to reduce stress concentrations at these corners and to assist abutment of tip 284 in cut-out 286.

Tips 284 are secured to arms 64 in the most preferred form by first and second, elongated bolts 308 extending through spaced, parallel apertures 310 formed in arms 64 extending parallel to the faces thereof and generally parallel to the axially outer end and to the width thereof and threaded into apertures 312 extending generally perpendicular to surface 292 of tip 284. It can then be appreciated that the heads of bolts 308 are at the trailing edge of arms 64 where they are not generally exposed to wear. Tips 284 are also secured to arms 64 in the most preferred form by a third bolt 314 extending through an aperture 316 formed in tips 284 extending parallel to end 296 and perpendicular to surfaces 294 and 298 and threaded into aperture 318 in the free end of arms 64 generally perpendicular to apertures 310.

Aperture 316 includes a counterbore 320 extending from surface 298 towards but spaced from surface 294 to recess the head of bolt 314 to enable surface 298 to wear away to a minimal thickness before the integrity of bolt 314 becomes at risk due to wear. In the most preferred form, apertures 312 are elongated beyond their threaded portions in which bolts 308 are received and act as a visual indicator for the condition of tip 284 as the inner, unthreaded ends of apertures 312 become exposed as surface 302 forming the leading edge of arm 64 is worn away and thus serves to assist in determining the scheduled replacement of tip 284. It of course can be appreciated that tips 284 must be replaced in a minimum of one pair per rotor 48–50, i.e. on arms 64 diametrically across from each other to maintain good dynamic balance of rotors 48–50 and shaft 44. In this regard, tips 284 are manufactured to have consistent, accurate weights to reduce or eliminate dynamic balance problems. Furthermore, in the most preferred form, dowel pins 322 are slideably received in bores 324 formed in arm 64 and bores 326 formed in tip 284 generally perpendicular to surface 292 with a close tolerance fit for accurately placing tip 284 at accurate, constant distances from shaft 44 for dynamic balancing of rotors 48–50 and shaft 44. Surface 292 and the leading surface of cut-out 286 with which it abuts are machined to facilitate trouble free fit and operation of arm 64, with this feature being important due to the high forces that act on tip 284 and arm 64.

Prior to the present invention, arms 64 without tips 284 had to be replaced after 20% of arm 64 was worn away. Tips 284 according to the preferred teachings of the present invention are designed to be replaced when up to 80% of tips 284 are worn away while the remaining portions of arms 64 are not as subject to wear and typically will not require replacement. Specifically, wear of arms 64 generally occurs along the leading edge and increases with radial spacing from the axis of shaft 44 and is greatest at the leading, radially outer corner in the direction of rotation of arm 64. According to the preferred teachings of the present invention, this portion of greatest wear in arm 64 is then located in tips 284 according to the preferred teachings of the present invention. This results in several advantages. Specifically, it is much more economical to replace tips 284 than the whole arm 64 as was required prior to the present invention. Likewise, it is easier to ship and more economical for the manufacturer to treat tips 284 for wear resistance than whole arms 64. Similarly, it is easier to store and ship tips 284 than whole arms 64 for replacement of the worn portions of arms 64 in the rotor assembly. Additionally, tips 284 can be formed from expensive, exotic, abrasion and impact resisting metal alloys while the remaining portions of arms 64 can be formed of less expensive material. Likewise, it is easier and faster to replace tips 284 than the whole arm 64 which would require removal of bolts 130 and 132 in the most preferred form, thus reducing downtime of mill 10 to replace the worn portions of rotors 48–50. The increasing angle of surface 302 maximizes the material which can be worn to match that of the normal wear of arms 64, with the greater width of end 300 than the width of cut-out 286 providing substantially increased amount of material than if surface 302 which forms the leading edge of tip 284 was linear with the leading edge of the remaining portion of arm 64. In this regard, chamfer 304 allows for maximizing wear material while still protecting the remaining portion of arm 64 from wear and not creating a corner that forces might act upon to break tip 284 from the remaining portion of arm 64. Further, the angle of surface 302 is believed to affect the efficiency and performance of the disintegration process. It can then be appreciated that tips 284 according to the preferred teachings of the present invention allow more economical experimentation with the particular angle of surface 302 for improved efficiencies and/or applications, and otherwise advantageous for allowing conversions between different mill applications.

Leg 290 according to the preferred teachings of the present invention is designed for the most efficient use of material used to make tip 284. If wear is experienced at the trailing, radially outer corner in the direction of rotation of arm 64, leg 290 could be lengthened to extend beyond the trailing, radially outer corner and therefore protecting it from wear or the shape of arm 64 could be revised such as with a fillet or chamfer at the trailing, radially outer corner. Also, surface 302 could be sharpened according to the preferred teachings of the present invention to act as a replaceable cutter or could be otherwise shaped into other configurations for use in specific processes.

According to the preferred teachings of the present invention, tips 284 are attached without relative movement to arms 64 in a very secure manner through the use of bolts 308 and 314. If tips 284 were to release from arms 64, they can become rapidly traveling projectiles. Even in such an event, the preferred design of mill 10 typically will prevent such released tip 284 from traveling out of or through housing 12 and thereby resulting in relatively safer operation when compared to tub grinders or hammer mills where such projectiles are more of a problem.

Now that the basic teachings of the present invention have been explained, many extensions and variations will be obvious to one having ordinary skill in the art. For example, provisions 140 according to the preferred teachings of the present invention generally of the type located between top plate 28 and rotor 48 could also be utilized between rotors 48–50. Such a modification could be accomplished by increasing the radial spacing of outer edges 248 of wing plates 240 by increasing the width of bars 242 and 244. Wing plates 240 could be lengthened in a direction parallel to shaft 44 to mount to or contact bolts 130, arm 64, and/or disc 54 above and/or below hub assembly 60, with the addition of braces between wing plates 240 possibly being necessary due to increased stress. Inner edges 246 of wing plates 240 could abut with shaft 44 to prevent material from wrapping around an individual wing plate 240 and without requiring the use of a shield, with inner edges 246 being suitably notched for hub assemblies 60. Discs 272 and pins 274 would not be necessary between rotors 48–50 if carriers **264*a* and 264*b* are utilized to secure wing plates 240 to shaft 44 between rotors 48–50. However, it is believed that provisions 140 between rotors 48–50 according to the preferred teachings of the present invention are advantageous because they are more economical to produce and are more effective in distributing bending moments of shaft 44 between bearings 46 since wing plates 240 are attached to discs 54 of rotors 48–50 at a larger radial spacing between rotors 48–50 than for provisions 140 between top plate 28 and rotor 48** of the most preferred form.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Replaceable tip for an arm rotatable in a mill, with the arm having a radially inner end, a radially outer end and a leading edge in the direction of rotation of the arm comprising, in combination: a body portion having a first leg abutting with the leading edge and a second leg abutting with the radially outer end; a first bolt extending through the arm and threaded into the first leg; and a second bolt extending through the second leg and threaded into the radially outer end of the arm; wherein the second bolt includes a head; wherein the second leg includes a counterbore for receiving and recessing the head when the second bolt is threaded into the radially outer end; wherein the leading edge includes a cut-out for at least partially receiving the first leg, with the cut-out having a width extending in the direction of rotation; wherein the first leg has a width extending in the direction of rotation greater than the width of the cut-out; wherein the first leg includes a free end having a width extending in the direction of rotation, a first surface for abutting with the leading edge, and a second surface spaced from the first surface for a distance greater than the width of the cut-out, with the free end extending between the first and second surfaces; and wherein the replaceable tip further comprises, in combination: a chamfer formed between the free end and the second surface and having a width along the free end equal to the difference between the width of the free end and the width of the cut-out.

2. The replaceable tip of claim 1 wherein the arm includes first and second flat, parallel faces, with the arm being rotatable about an axis perpendicular to the faces of the arm, with the arm having a thickness defined between the first and second faces; and wherein the replaceable tip has a thickness generally equal to 115% to 125% of the thickness of the arm.

3. The replaceable tip of claim 2 wherein the second leg includes a surface for abutting with the radially outer end and which is perpendicular to the first surface of the first leg.

4. Device for combating material from wrapping around a shaft rotatable about an axis inside of a hollow chamber substantially larger than the shaft comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with each of the wing plates being formed by interconnecting two relatively shiftable plate members wherein each of the wing plates is selectively adjustable in length in a direction extending parallel to the shaft.

5. Device for combating material from wrapping around a shaft rotatable about an axis inside of a hollow chamber substantially larger than the shaft comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the wing plates being of a readily variable length parallel to the shaft; wherein the wing plates each comprise, in combination: first and second bars which are slideable relative to each other.

6. The anti-wrap device of claim 5 wherein the first and second bars each include a slot extending parallel to the axis; and wherein the wing plates each further comprise, in combination: at least a first bolt extending through the slots of the first and second bars.

7. The anti-wrap device of claim 5 wherein the mounting means comprises, in combination: a disk, with the first bar secured generally perpendicular to the disk; and means for securing the disk to the shaft in a plane perpendicular to the shaft.

8. The anti-wrap device of claim 7 wherein the securing means comprises, in combination: first and second semicylindrical carriers; and means for securing the first and second semicylindrical carriers together with the shaft sandwiched between the first and second semicylindrical carriers, with the disk being secured to at least one of the first and second semicylindrical carriers.

9. The anti-wrap device of claim 8 wherein the disk has first and second faces, with the semicylindrical carriers and the first bar extending from the first face; and wherein the first bar includes an inner edge having a cut-out for the semicylindrical carriers allowing the inner edge axially outside of the cut-out to abut with the shaft.

10. The anti-wrap device of claim 9 wherein the second bar includes a free end and an inner edge having a cut-out for the semicylindrical carriers allowing the free end of the second bar to slide past the semicylindrical carriers.

11. The anti-wrap device of claim 10 wherein the disk further includes a multiplicity of pins which upstand from the second face parallel to and spaced from the shaft.

12. The anti-wrap device of claim 8 wherein the disk has first and second faces, with the semicylindrical carriers and the first bar secured to the first face; and wherein the disk further includes a multiplicity of pins which upstand from the second face parallel to and spaced from the shaft.

13. The anti-wrap device of claim 5 wherein the shaft includes a rotor having a surface extending in a plane perpendicular to the axis; and wherein the mounting means comprises, in combination: a foot secured to the second bar, and means for securing the foot to the surface of the rotor.

14. The anti-wrap device of claim 12 wherein the rotor includes a removable arm, with the foot securing means comprising a bolt passing through the foot, the arm, and the rotor, with the bolt being offset from the second bar allowing access by a wrench.

15. Device for combating material from wrapping around a shaft rotatable about an axis inside of a hollow chamber substantially larger than the shaft comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the wing plates being of readily variable lengths parallel to the shaft; wherein the wing plates each have an inner edge which abuts with the shaft to prevent material from wrapping around an individual wing plate.

16. Device for combating material from wrapping around a shaft rotatable about an axis inside of a hollow chamber substantially larger than the shaft comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the wing plates being of readily variable lengths parallel to the shaft; wherein the wing plates each have an outer edge of a decreasing radial size to predispose material which should wrap around the multiplicity of wing plates to migrate in the direction of the decreasing radial size.

17. In a mill including a shaft rotatable about an axis inside of a hollow chamber substantially larger than the shaft and at least one rotor secured to the shaft inside of the hollow chamber, with the rotor including an arm having a radially inner end, a radially outer end and a leading edge in the direction of rotation of the shaft, the improvement comprising, in combination: a replaceable tip for the arm; and a device for combating material from wrapping around the shaft; wherein the replaceable tip comprises, in combination: a body portion having a first leg abutting with the leading edge and a second leg abutting with the radially outer end; a first bolt extending through the arm and threaded into the first leg; and a second bolt extending through the second leg and threaded into the radially outer end of the arm; and wherein the anti-wrap device comprises, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the wing plates being of readily variable, lengths parallel to the shaft.

18. The replaceable tip of claim 1 wherein the second leg includes a surface for abutting with the radially outer end and intersecting generally perpendicular with the first surface of the first leg at a corner; and wherein the replaceable tip further comprises, in combination: a fillet at the corner of the first surface of the first leg and the surface of the second leg and extending beyond the first surface of the first leg and the surface of the second leg for assisting in the abutment of the first surface of the first leg and the surface of the second leg with the leading edge and the radially outer end of the arm, respectively.

19. The replaceable tip of claim 1 further comprising, in combination: at least a first bore formed in the first surface; and a dowel pin slideably received in the bore of the first surface and a bore formed in the leading edge of the arm with a close tolerance fit.

20. The anti-wrap device of claim 8 wherein each of the wing plates include means for removably fixing the wing plates at one of the various lengths.

21. Device for combating material from wrapping around a shaft rotatable about an axis inside of a hollow chamber substantially larger than the shaft comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the wing plates being of readily variable lengths parallel to the shaft; with the shaft including a rotor, with the rotor including a flat disc secured to and rotatable with the shaft and further including a multiplicity of arms each removably secured to the disc by at least first and second bolts extending through the arm at differing radial distances from the shaft, with the second bolt having lesser shear strength than the first bolt such that the arms are allowed to pivot about the first bolt in the event that the second bolt is sheared.

22. Device for combating material from wrapping around a shaft rotatable about an axis inside of a hollow chamber substantially larger than the shaft, with the shaft including a rotor having a surface extending in a plane perpendicular to the axis, comprising, in combination: a multiplicity of wing plates; and means for mounting the wing plates orientated to extend generally radially from the shaft to a radial extent from the shaft substantially smaller than the chamber at circumferentially spaced locations around the shaft, with the radial extent of the wing plates effectively increasing the circumference of the shaft and the length of the material which could potentially wrap thereon, with the mounting means comprising, in combination: a radially extending foot secured to each of the wing plates, and a first bolt for each of the feet of the wing plates passing through the respective foot and the rotor parallel to the shaft; wherein the rotor includes a removable arm, with the foot securing means further comprising, in combination: a second bolt extending through the arm and the rotor at a differing radial distance from the shaft than the first bolt, with the first bolt extending through the arm, with the second bolt having lesser shear strength than the first bolt such that the arm is allowed to pivot about the first bolt in the event that the second bolt is sheared.

23. The anti-wrap device of claim 22 wherein the first bolt is offset from the wing plate to allow access by a wrench.

24. The anti-wrap device of claim 13 wherein the rotor includes a removable arm, with the foot securing means comprising, in combination: a first bolt passing through the foot, the rotor and the arm; and a second bolt extending through the arm and the rotor at a differing radial distance from the shaft than the first bolt, with the second bolt having lesser shear strength than the first bolt such that the arm is allowed to pivot about the first bolt in the event that the second bolt is sheared.

* * * * *

UNITED STATES PATENT AND TRADEMARK OFFICE

CERTIFICATE OF CORRECTION

PATENT NO. : 5,685,500

DATED : November 11, 1997

INVENTOR(S) : Eide et al.

It is certified that error appears in the above-identified patent and that said Letters Patent is hereby corrected as shown below:

Column 14, line 3, cancel "8" and substitute therefor --4--.

Signed and Sealed this

Twenty-fourth Day of February, 1998

*Attest:*

Bruce Lehman

BRUCE LEHMAN

*Attesting Officer*

*Commissioner of Patents and Trademarks*